US006540087B2

(12) United States Patent
Nemedi et al.

(10) Patent No.: US 6,540,087 B2
(45) Date of Patent: Apr. 1, 2003

(54) PART SEPARATOR HAVING MULTIPLE INLETS AND METHOD OF SUPPLYING WET CHIPS THROUGH MULTIPLE INLETS

(75) Inventors: William D. Nemedi, Paw Paw, MI (US); Robert J. Nemedi, Kalamazoo, MI (US)

(73) Assignee: Inter-Source Recovery Systems, Inc., Kalamazoo, MI (US)

( * ) Notice: Subject to any disclaimer, the term of this patent is extended or adjusted under 35 U.S.C. 154(b) by 0 days.

(21) Appl. No.: 09/769,659

(22) Filed: Jan. 25, 2001

(65) Prior Publication Data

US 2002/0096454 A1 Jul. 25, 2002

(51) Int. Cl.[7] ..... B07B 7/04; B07B 11/06; B07B 7/01

(52) U.S. Cl. ..... 209/146; 209/137; 209/149

(58) Field of Search ..... 209/149, 137, 209/136, 146, 135

(56) References Cited

U.S. PATENT DOCUMENTS

| | | | | | |
|---|---|---|---|---|---|
| 21,945 | A | * | 11/1858 | Cox | 209/137 |
| 1,418,866 | A | * | 6/1922 | Dennig | 209/137 |
| 1,517,595 | A | * | 12/1924 | Stebbins | 209/146 |
| 1,660,682 | A | * | 2/1928 | Stebbins | 209/146 |
| 2,203,821 | A | * | 6/1940 | Hinchman | 209/146 |
| 2,203,959 | A | * | 6/1940 | Hammack | 209/146 |
| 2,978,103 | A | * | 4/1961 | Cowher, Sr. | 209/137 |
| 3,058,590 | A | * | 10/1962 | Larson et al. | 209/137 |
| 3,441,131 | A | * | 4/1969 | Gebauer | 209/146 |
| 4,211,641 | A | * | 7/1980 | Jager | 209/144 |
| 4,310,417 | A | | 1/1982 | Dudley et al. | 210/375 |
| 4,441,995 | A | * | 4/1984 | Dudley | 209/137 |
| 4,772,380 | A | * | 9/1988 | Cramer et al. | 209/2 |
| 4,936,822 | A | | 6/1990 | Nemedi | 494/43 |
| 5,106,487 | A | * | 4/1992 | Nemedi | 209/12 |
| 5,264,124 | A | | 11/1993 | Nemedi | 210/380.1 |
| 5,464,310 | A | | 11/1995 | Federhen | 406/164 |
| RE35,307 | E | | 7/1996 | Nemedi | 494/43 |

FOREIGN PATENT DOCUMENTS

| | | | | | |
|---|---|---|---|---|---|
| DE | 630756 | | * | 5/1936 | 209/137 |
| JP | 0062271 | | * | 6/1978 | 209/137 |
| SU | 1535655 | | * | 1/1990 | 209/146 |
| SU | 001669591 | A1 | * | 8/1991 | 209/137 |
| SU | 001722617 | A1 | * | 3/1992 | 209/137 |

* cited by examiner

*Primary Examiner*—Donald P. Walsh
*Assistant Examiner*—Daniel K Schlak
(74) *Attorney, Agent, or Firm*—Marshall, Gerstein & Borun

(57) ABSTRACT

A parts separator is provided for separating undesired heavy material from wet chips. The parts separator is adapted to be attached to a centrifugal separator, and includes a first chute member having a top portion and a bottom portion and including spaced open first and second chute ends. The first end is adapted to receive wet chips to be centrifuged and the second end is adapted to be connected to a centrifugal parts separator. The parts separator also includes a heavy material drop out opening disposed in the first chute member bottom portion. The first chute member top has at least one opening disposed therein. The parts separator also includes a second chute member having spaced open first and second ends. The first end of the second chute member is adapted to receive wet chips to be separated and the second chute member end is attached to the first chute member at the location of the opening in the first chute top portion. Wet chips in the second chute member can pass through the opening in the top portion and pass into the first chute member.

11 Claims, 3 Drawing Sheets

PART SEPARATOR HAVING MULTIPLE INLETS AND METHOD OF SUPPLYING WET CHIPS THROUGH MULTIPLE INLETS

FIELD OF THE INVENTION

The present invention is directed to an improved parts separator for use with a centrifugal separator and more particularly to a parts separator having a plurality of air and/or wet chip material openings.

BACKGROUND OF THE INVENTION

It is known to have systems for separating, fluids from other materials such as the separation of metal chips generated in the course of a machining operation from lubricating oils. An example of such a system is shown and disclosed in U.S. Pat. No. 5,106,487, the entire disclosure, drawings and claims of which are incorporated herein by reference. The 487' patent illustrates a system for separating undesired, heavy metal parts from wet chips prior to the entry of the wet chips into a centrifugal separator where lubricating oil is separated from the chips. While the type of materials separation system disclosed in the 487' patent is satisfactory in many applications, it has been found, however, that with some applications, the parts separator is not entirely satisfactory.

Applications exist where wet chips are to be gathered from multiple points of origin with the wet chips being conveyed to a single parts separator prior to entry of the wet chips into a centrifugal separator. In some instances, it may be desirable or necessary to have the wet chips from one source pass to the parts separator by a mechanical conveyor or the like where heavy, unwanted metal pieces, e.g., machine screw, tool, etc. can be separated out from the wet chips to be centrifuged. In other instances, however, wet chips from a source of origin may be pneumatically delivered to the parts separator in a fluid stream such as disclosed in Nemedi application U.S. Ser. No. 09/504,764 filed Feb. 15, 2000, the entire disclosure, drawings and claims of this are incorporated herein by reference. In this pneumatic wet chip delivery system, it is contemplated that heavy unwanted pieces could, if desired, be removed from the wet chips to be centrifuged at the location of the source of origin of wet chips, e.g., a machine tool site where the wet chips are generated. More specifically, in the pneumatic wet chip delivery system, unwanted heavy pieces arc removed by passing the wet chips through a parts separator prior to the wet chips entering the pneumatic fluid wet chip flow. In other instances, however, it is desired to convey the wet chips and heavy parts pneumatically to a parts separator which is attached directly or indirectly to a centrifugal separator. This is particularly desired in cases where wet chips are conveyed pneumatically or pneumatic and/or mechanically from a plurality of sources to a parts separator. Accordingly, it is desired to have a parts separator with multiple openings to allow for multiple sources of pneumatic fluid and/or wet chips to enter the parts separator.

Further, in conventional wet chip separation systems presently available, a parts separator often includes a rotary air lock assembly which is located at the location of the wet chip inlet chute. The air lock assembly serves to preclude pneumatic fluid from entering the parts separator at the location of the wet chip entry chute. Accordingly, upon actuation of the centrifuge separator, to which the parts separator normally is attached, a vacuum is created in the parts separator and pneumatic fluid, i.e., air, is pulled into the parts separator primarily through the heavy material drop out chute. While this source of air is sufficient in many applications, in instances where wet chips are pneumatically conveyed to the parts separator, other air or fluid sources, aside from the air entering the centrifugal separator through the parts separator drop out chute, are required.

Accordingly, what is desired is to have a parts separator adapted for receipt of wet chip materials through multiple inlet conduits. Additionally, it is desired to have a parts separator having a plurality of openings adapted to supply wet chips and/or pneumatic fluid to and through the parts separator.

SUMMARY OF THE INVENTION

The system and apparatus of the present invention serve to achieve the advantages desired for a wet chip parts separator.

Briefly, the invention disclosed and claimed herein relates to a parts separator which is adapted to include a plurality of inlet chutes for material and/or air whereby heavy parts can be separated from the wet chips to be centrifuged at the location of a drop out chute while wet chips pass to a centrifugal separator where separation occurs resulting in dry chips and fluid. Additionally, having multiple entry chutes in the parts separator provides for multiple pneumatic fluid entry points in the parts separator which particularly, in the instance where wet chips are pneumatically delivered to a centrifugal separator, is desirable. Accordingly, the present invention provides a parts separator which includes a heavy material drop out chute and multiple entry chutes for the entry of wet chips, pneumatic fluid or a mixture of wet chips and pneumatic fluid.

These and other features, advantages, and objects of the present invention will he further understood and appreciated by those skilled in the art by reference to the following specification, drawings, and claims.

DETAILED DESCRIPTION

Figure 1:
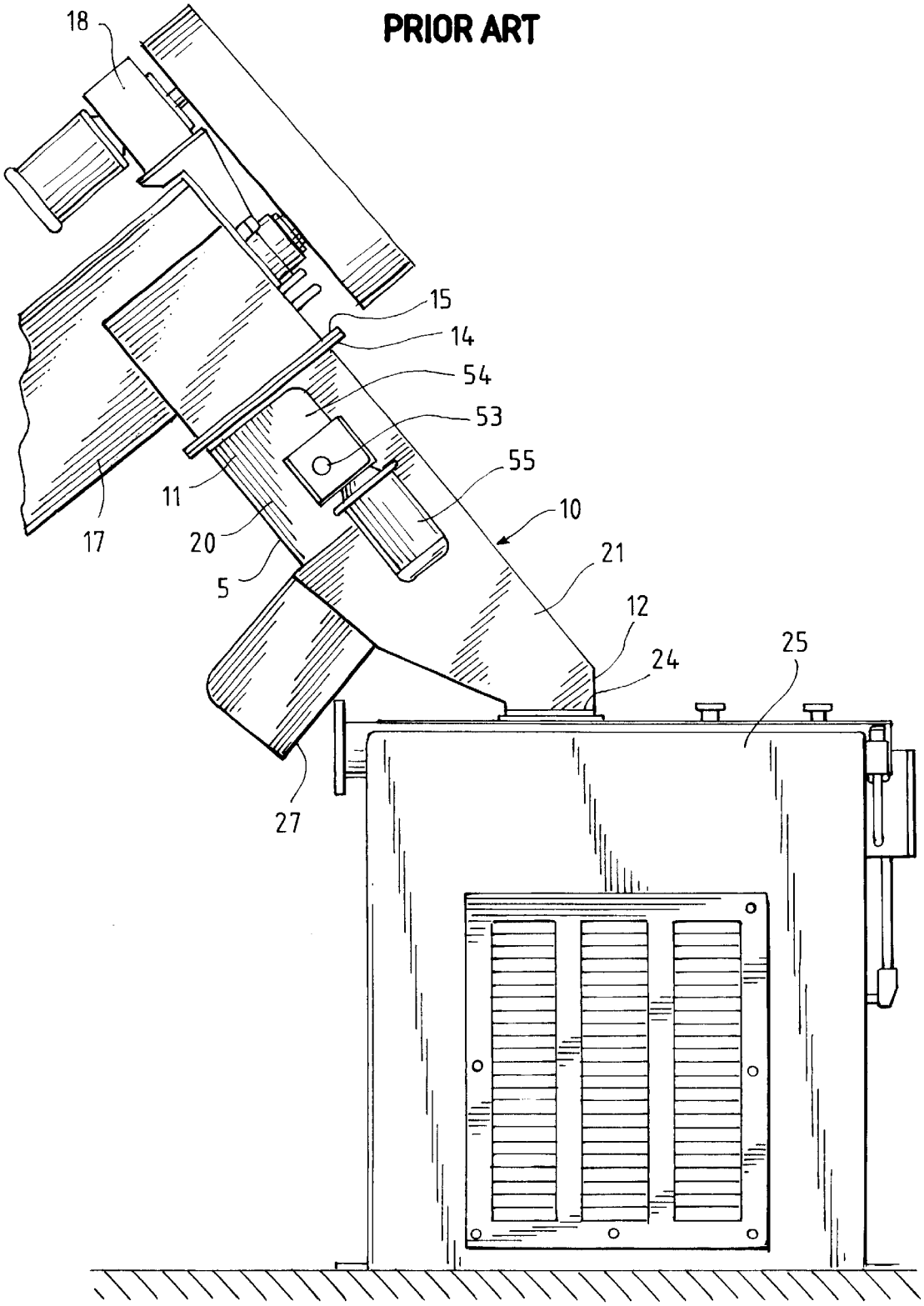
FIG. 1 PRIOR ART
FIG. 1 shows a side, fragmentary view of a prior art parts separator connected at one end to a conventional wet chip conveyor feeder and at the opposite end to a conventional centrifugal separator.

Referring to FIG. 1, parts separator 10 has an outboard end 11 and an inboard end 12 located downstream from the end 11. Material receiving outboard end 11, flanged at 14, is connected to flange 15 of a conventional mechanical conveyor such as an auger type conveyor 17 having a drive assembly 18. Conveyor 17 conveys both wet chips to be separated and heavy metal pieces to parts separator 10.

The prior art parts separator device 10 illustrated in FIG. 1 and described in detail in the above-referenced '487 patent comprises a first chute member 5 comprising a first portion 20 which extends in a first direction from wet chip receiving outboard end 11 and a second portion 21 which extends in the first direction and is positioned contiguous to a heavy piece drop out opening located in the bottom wall 19 at the exit end of chute portion 20. A drop out chute 27 is positioned below heavy material drop out opening.

End 12 of part separator 10 includes flange 24 which is illustrated as being connected to a complementary flange located on the top wall of a conventional centrifugal separator 25 such as illustrated and offered for sale by Intersource Recovery Systems, Inc., Kalamazoo, Mich. and shown in Inter-Source's catalog entitled "Chip Processing," copyrighted in 1997.

Figure 2:
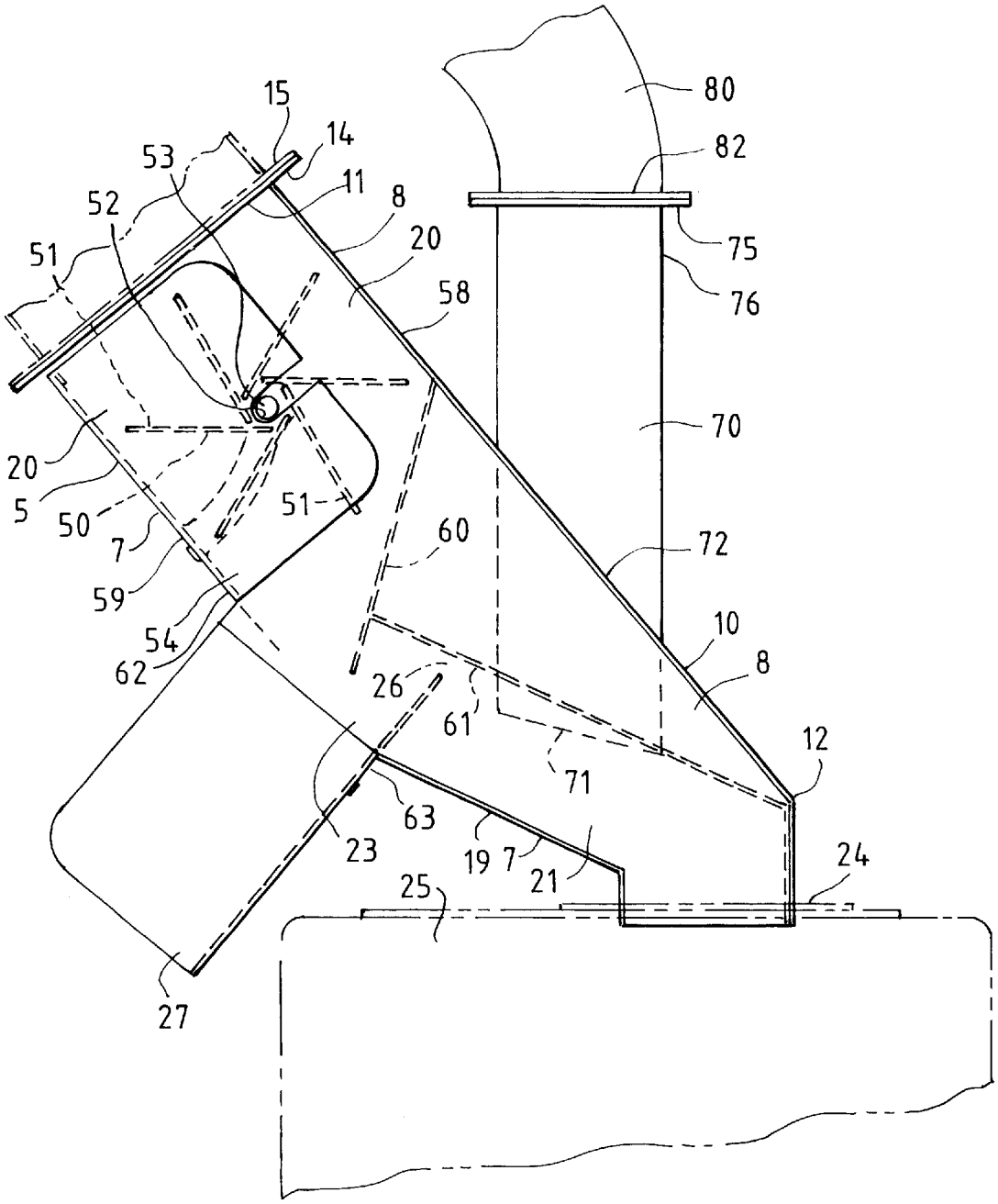
FIG. 2 shows a fragmentary, side section view of a parts separator embodiment of the present invention having multiple pneumatic fluid and wet chip inlets and including a rotary air seal lock located in one wet chip material inlet chute.

A rotary air-seal assembly 50, as illustrated in FIG. 2, is disposed in first chute portion 20. Assembly 50 comprises a plurality of equally spaced, relatively stiff, but flexible paddle wheel blades 51 connected to hub 52. Hub 52 is positioned on rotatable shaft 53 connected to suitable bearings, located in the side walls 54 of first chute portion 20. Shaft 53 is connected to motor 55 or other suitable drive means which serve to drive blades 51 in a counterclockwise direction. The outer edges of the blades are spaced a short distance from chute walls 58, 59 such that while the blades serve to act as a seal to some extent, they also serve to contact material in first chute portion 20 and assist it as it slides along the bottom wall 59 of first chute portion 20.

Baffle plates 60, 61, illustrated in FIG. 2, are disposed within parts separator 10 to assist in directing materials through parts separator 10. Adjustably mounted baffle plates 62, 63 also are provided to increase and decrease the area surrounding material drop out opening 23 at the exit end of the first chute portion 20 and the size of the area in entrance opening 26 of the second chute portion 21.

FIG. 2 illustrates a parts separator having the structure of the separator illustrated in FIG. 1 with the addition however of a second chute member 70. Chute member 70 has an inboard end 71 which intersects with and is attached or joined, for example by welding, to the top wall 72 of chute portion 21. First chute 5 is shown as comprising a top portion 8 which includes chute top 72 and a portion of the side walls 54 extending from the top wall. Chute member 5 also includes a bottom portion 7 which includes chute bottom 19 and a portion of side walls 54 extending from the chute bottom and terminating as the side walls extending from the top portion 8.

Chute member 70 includes flange 75 located at its remaining outboard end 76. Flange 75 is adapted to connect to flange 82 of a pneumatic wet chip conduit member 80, such as shown and disclosed in our pending application U.S. Ser. No. 09/504,480 filed Feb. 15, 200. Conduit member 80 serves to pneumatically convey wet chips, from which heavy parts already have been separated at the location of the tool machine site where the wet chips are generated prior to the wet chips entering pneumatic conduit 80. The wet chips from conduit 80 enter chute member 70 and drop into chute portion 21. In chute portion 21, the wet chips that entered separator 10 from conveyor 17 mix with wet chips that entered separator 10 through chute member 70. The combined wet chips pass into centrifugal separator 25 where they are centrifuged resulting in dry chips and fluid. Similarly, if desired, the opening in end 76 of chute member 70 could be open to the atmosphere with the opening serving as a source of pneumatic fluid entering centrifugal separator 25. Further, in place of an auger type conveyor 17, the wet chips could be conveyed by a pneumatic conveyor system as described in our aforementioned patent application Ser. No. 09/504,580.

If desired, additional chute members 70 can be attached to parts separator 10. Each of these additional chute members can be connected to a pneumatic fluid conduit such as conduit 80, or the chute member may be open to the outside air at outboard chute end 76 to provide multiple fluid openings in part separator 10. When centrifugal separator 25 is actuated, fluid, such as air, will be pulled into the parts separator through drop out openings 23 as well as the opening at end 71 of a chute 70. In the event unwanted heavy parts have not been removed at a machine site, the conduit, such as 80, can be attached to a chute 70 disposed in the top wall portion of the first portion 20 whereby the wet chips and heavy parts pass over the drop out opening above chute 27 where heavy parts drop out of the drop out opening.

Figure 3:
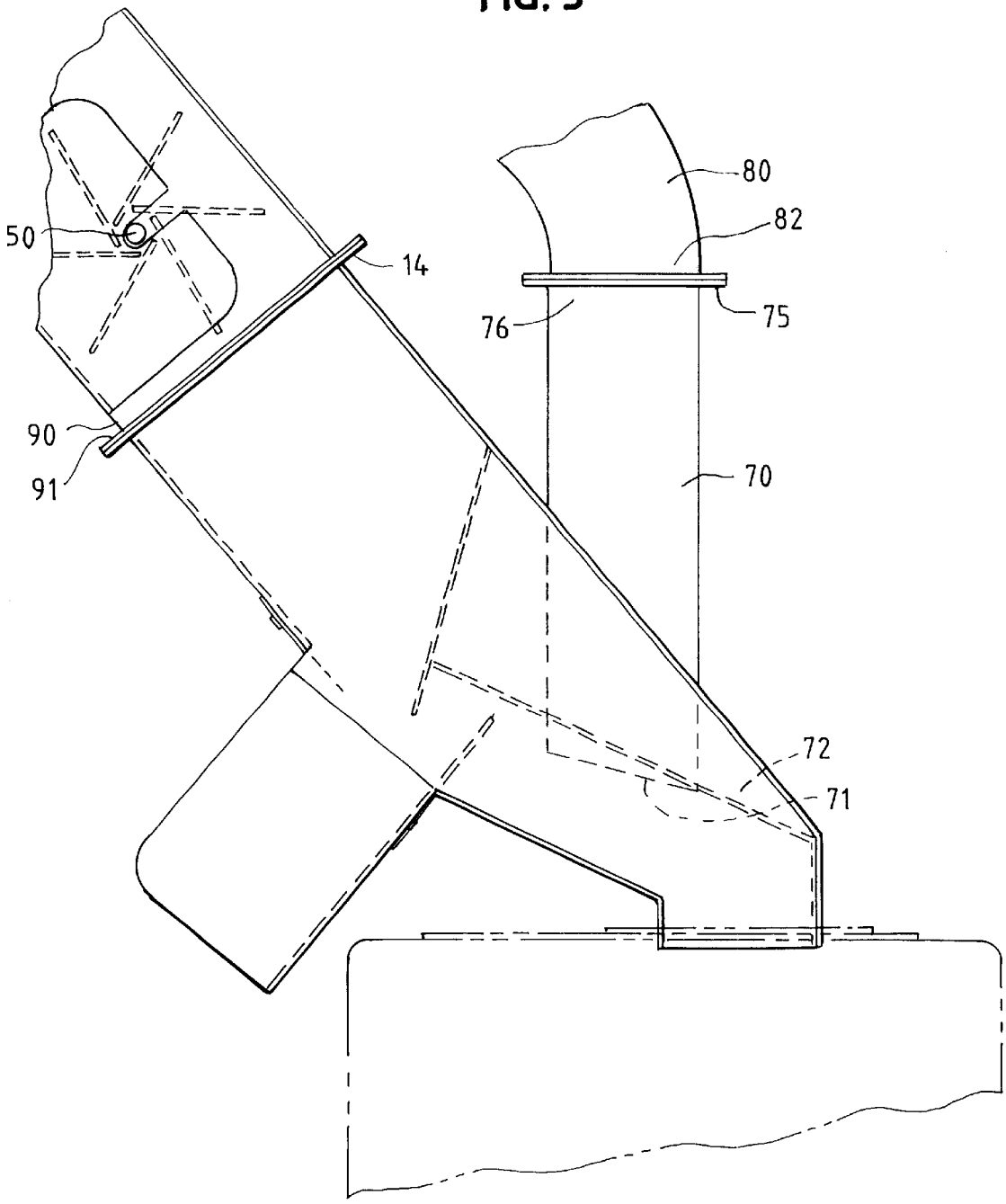
FIG. 3 shows a fragmentary, side section view of the parts separator embodiment of FIG. 2 with the rotary air seal of FIG. 2 moved outside of the parts separator.

FIG. 3 shows the embodiment of FIG. 2 save the rotary air-seal assembly 50 has been moved outside parts separator 10. The rotary air-seal assembly 50 in this embodiment is disposed in chute member 90. Chute member 90 has flanges 91, only one of which is shown at each end of member 90. A flange 91 is connected to flange 14 of parts separator 10 while the remaining flange 91 is attached to flange 15 of conveyor assembly 17.

While the present invention has been described with reference to the various embodiments shown, it will be apparent to those of ordinary skill in the art that changes, additions and/or deletions may be made to the disclosed embodiments without depicting from the spirit and scope of the invention.

What is claimed is:

1. A wet chip separation assembly for separating wet chips into dry chips and fluid, said assembly comprising at least one wet chip conveyor including a wet chip conduit having a wet chip exit opening;

a centrifugal separator for separating wet chips into dry chips and fluids, said separator including a wet chip receiving opening;

a parts separator for separating undesired heavy material from wet chips, said parts separator being disposed between said wet chip conveyor and said centrifugal separator, said parts separator including:

a first chute member having a top portion, a bottom portion and spaced open outboard upstream and inboard downstream first chute member ends;

said first chute member being connected to said wet chip conveyor at said outboard upstream chute end of said first chute member;

said inboard downstream end of said first chute member being positioned contiguous to said centrifugal separator whereby wet chips from said parts separator enter said centrifugal separator, said top portion of said first chute member having at least one top portion opening, said bottom portion of said first chute member having a heavy material drop out opening;

a second chute member having spaced open outboard and inboard ends; said inboard end of said second chute member being joined to said first chute member at said top portion opening, and said top portion opening being disposed downstream of said drop out opening; and a second wet chip conveyor, said outboard end of said second chute member being attached to said second wet chip conveyor.

2. A wet chip separator assembly in accordance with claim 1 wherein said outboard end of said second chute member serves as a source of pneumatic fluid to the centrifugal separator whereby fluid is directed through said second chute member into said first chute member.

3. A wet chip separator assembly in accordance with claim 1 wherein said first chute member has a plurality of spaced openings in said top portion, a plurality of second chute members, each second chute member including an open outboard end and a spaced open inboard end; and said inboard ends of said second chute members each being attached to said first chute member at the location of one of the plurality of spaced openings in said top portion.

4. A wet chip separator assembly in accordance with claim 1 and further including a pneumatic fluid seal assembly disposed within said first chute member for preventing substantial pneumatic fluid from entering said parts separator.

5. A wet chip separator assembly in accordance with claim 1 and further including a pneumatic fluid seal assembly disposed adjacent to and outside of said first chute member.

6. The wet chip separator assembly in accordance with claim 1 and further including an air seal assembly disposed contiguous to said outboard end of said first chute member and upstream from said heavy material drop out opening.

7. A method of delivering wet chips to be separated into dry chips and fluid in a wet chip separation assembly comprising:

at least one wet chip conveyor including a wet chip conduit having a wet chip exit opening;

a centrifugal separator for separating wet chips into dry chips and fluids and including a wet chip receiving opening;

a parts separator for separating undesired heavy materials from wet chips, said parts separator being disposed between said wet chip conveyor and said centrifugal separator, said parts separator including:

a first chute member having a top portion, a bottom portion and spaced open outboard upstream and inboard downstream first chute member ends;

said first chute member being connected to said wet chip conveyor at said outboard upstream chute end of said first chute member;

said inboard downstream end of said first chute member being positioned contiguous to said centrifugal separator whereby wet chips from said parts separator enter said centrifugal separator, said top portion of said first chute member having at least one top portion opening, said bottom portion of said first chute member having a heavy material drop out opening;

a second chute member having spaced open outboard and inboard ends; said inboard end of said second chute member being joined to said first chute member at said top portion opening, and said top portion opening being disposed downstream of said drop out opening, the method including the steps of:

passing wet chips to be separated into said open outboard end of said first chute member;

passing wet chips to be separated into said open outboard end of said second chute member and through said top portion opening;

thereafter passing said wet chips into said centrifugal separator, and separating said wet chips into dry chips and fluid.

8. A method of delivering wet chips from different sources of origin to be separated into dry chips and fluid in a wet chip assembly comprising:

a plurality of wet chips conveyors, each conveyor including a wet chip conduit having a wet chip exit opening;

a centrifugal separator for separating wet chips into dry chips and fluid and including a wet chip receiving opening;

a parts separator for separating undesired heavy materials from wet chips, said parts separator being disposed between said wet chips conveyors and said centrifugal separator, said parts separator including:

a first chute member having a top portion, a bottom portion and spaced open outboard and inboard chute member ends;

said first chute member being connected to a wet chip conveyor at said outboard end;

said inboard end of said first chute member being positioned contiguous to said centrifugal separator whereby wet chips from said part separator enter said centrifugal separator, said top portion of said first chute member having a plurality of spaced top portion openings;

a heavy material drop out opening disposed in said bottom portion of said first chute member, a plurality of second chute members, each second member having spaced open outboard and inboard ends, said inboard end of said second chute members being joined to said first chute member at the location of one of said plurality of top portion openings, the method including the steps of:

passing wet chips to be separated into said outboard end of said first chute member;

passing wet chips to be separated into said outboard end of at least one of the plurality of said second chute members, through at least one of said plurality of top portion openings and into said first chute member; and passing said wet chips received at said outboard end of said first chute member and at said at least one of said plurality of top portion openings through the inboard end of said first chute member into said centrifugal separator; and, separating wet chips in said centrifugal separator into dry chips and fluid.

9. The method in accordance with claim 8 and further including the step of delivering pneumatic fluid into said parts separator through said outboard end of at least one of said plurality of said second chute members and passing said pneumatic fluid into said parts separator through said at least one of said top portion openings.

10. A wet chip separator assembly for separating wet chips into dry chips and fluid, said assembly comprising:

at least one first wet chip conduit having a wet chip opening;

a centrifugal separator for separating wet chips into dry chips and fluid, said separator including a wet chip receiving opening;

a parts separator for separating undesired heavy material from wet chips, said parts separator being disposed between said wet chip conveyor and said centrifugal separator, said parts separator including:

a first chute member having a top portion, a bottom portion and spaced open outboard and inboard ends, said first chute member being connected to said wet chip conduit at said outboard end of said first chute member;

said first chute member being connected to said centrifugal separator at the downstream inboard end of said first chute member whereby wet chips from said parts separator enter said centrifugal separator;

said bottom portion of said first chute member having a heavy material drop out opening, said top portion of said first chute member having at least one top opening located downstream of said drop out opening;

a second chute member having spaced open outboard and inboard ends, said inboard end of said second chute member being joined to said first chute member at said first chute member top opening; and, an air seal assembly disposed contiguous to said outboard end of said first chute member, said air seal assembly being located upstream of said drop out opening; and a second wet chip conveyor, said outboard end of said second chute member being attached to said second wet chip conveyor.

11. The wet chip separator assembly in accordance with claim 10 and further including a second wet chip conduit having an opened, said second wet chip conduit being connected to said upstream outboard end of said second chute member whereby wet chips to be separated enter into said wet chip separator assembly through said second wet chip conduit and said second chute member.

* * * * *

UNITED STATES PATENT AND TRADEMARK OFFICE

CERTIFICATE OF CORRECTION

PATENT NO. : 6,540,087 B2
DATED : April 1, 2003
INVENTOR(S) : William D. Nemedi et al.

It is certified that error appears in the above-identified patent and that said Letters Patent is hereby corrected as shown below:

Column 8,
Line 6, claim 11 is hereby cancelled.

Signed and Sealed this

Sixteenth Day of September, 2003

JAMES E. ROGAN
*Director of the United States Patent and Trademark Office*